US010100605B2

(12) United States Patent
Gay et al.

(10) Patent No.: US 10,100,605 B2
(45) Date of Patent: Oct. 16, 2018

(54) DIFFERENTIAL SAFETY VALVE

(71) Applicant: Pioneer Natural Resources USA, Inc., Irving, TX (US)

(72) Inventors: Michael Glenn Gay, Norman, OK (US); Ann Kamel Fitzgerald, Dallas, TX (US); Theodore Lee Cottrell, Keller, TX (US); Phillip Graham Knight, Allen, TX (US)

(73) Assignee: Pioneer Natural Resources USA, Inc., Irving, TX (US)

( * ) Notice: Subject to any disclaimer, the term of this patent is extended or adjusted under 35 U.S.C. 154(b) by 683 days.

(21) Appl. No.: 14/602,886

(22) Filed: Jan. 22, 2015

(65) Prior Publication Data

US 2015/0204162 A1 Jul. 23, 2015

Related U.S. Application Data

(60) Provisional application No. 61/930,841, filed on Jan. 23, 2014.

(51) Int. Cl.
*E21B 34/06* (2006.01)
*E21B 34/14* (2006.01)
(Continued)

(52) U.S. Cl.
CPC ..... *E21B 34/06* (2013.01); *E21B 21/103* (2013.01); *E21B 34/08* (2013.01); *E21B 34/102* (2013.01);
(Continued)

(58) Field of Classification Search
CPC ..... E21B 34/06; E21B 21/103; E21B 21/10; E21B 34/08; E21B 34/102; E21B 34/14; E21B 2034/007; E21B 34/00; E21B 4/02
See application file for complete search history.

(56) References Cited

U.S. PATENT DOCUMENTS 4,691,779 A 9/1987 McMahan et al.
5,180,015 A 1/1993 Ringgenberg et al.
(Continued)

OTHER PUBLICATIONS

International Search Report and Written Opinion received in corresponding PCT application No. PCT/US2015/012458 dated May 26, 2015.

(Continued)

*Primary Examiner* — Wei Wang
(74) *Attorney, Agent, or Firm* — Blank Rome LLP

(57) ABSTRACT

A valve for limiting differential pressure applied to a downhole tool includes a housing and a movable piston/mandrel assembly therein. In a closed position, drilling mud or other fluid may be communicated through a central bore of the valve to the tool. When the differential pressure between the central bore and the wellbore exceeds a first predetermined value, the piston/mandrel assembly moves from a first position obstructing one or more relief ports to a second position not obstructing them, thereby providing a fluid path from the central bore of the valve to the wellbore bypassing the tool and relieving the differential pressure thereacross. When the differential pressure decreases to less than another preselected value, the piston/mandrel assembly returns to its original position again obstructing the relief ports. A trigger mechanism is provided to allow more precise control and separation of the preselected differential pressure values.

32 Claims, 4 Drawing Sheets

(51) Int. Cl.

| | |
|---|---|
| ***E21B 34/10*** | (2006.01) |
| ***E21B 34/08*** | (2006.01) |
| ***E21B 21/10*** | (2006.01) |
| ***E21B 34/00*** | (2006.01) |

(52) U.S. Cl.
CPC ..... *E21B 34/14* (2013.01); *E21B 2034/007* (2013.01)

(56) References Cited

U.S. PATENT DOCUMENTS

| | | | | |
|---|---|---|---|---|
| 5,826,661 | A | 10/1998 | Parker et al. | |
| 6,220,359 | B1 | 4/2001 | Poulard | |
| 6,263,969 | B1 * | 7/2001 | Stoesz ..... | E21B 21/103 137/115.08 |
| 2003/0155131 | A1 | 8/2003 | Vick, Jr. | |
| 2015/0096807 | A1 * | 4/2015 | Strilchuk ..... | E21B 4/02 175/57 |

OTHER PUBLICATIONS

First Office Action received in corresponding Canadian application No. 2937834, dated Jul. 12, 2017, 3-pgs.

* cited by examiner

DIFFERENTIAL SAFETY VALVE

BACKGROUND OF THE INVENTION

Mud motors, also known as drilling motors, are used in many oil and gas well drilling operations to supply power in the form of rotational mechanical energy downhole. This rotational mechanical energy can be applied to the drill bit, either for increased rate of penetration or for deviation of a wellbore, as in directional drilling operations. Additionally, or alternatively, mud motors can be used for other operations such as driving an electrical generator to power measuring while drilling (MWD) or logging while drilling (LWD) equipment. Mud motors are powered by the flow of drilling fluid, also known as drilling mud, which is pumped down through the drill pipe and drives the mud motor. Mud motors are substantially similar in construction to progressive cavity pumps, and typically include a power section, in which the flow of drilling fluid causes a helical rotor having a certain number of lobes to eccentrically rotate within a stator having at least one additional lobe. This eccentric rotation is typically converted into concentric rotation by a transmission section, which may include, for example, a constant-velocity joint or other equivalent mechanical arrangement.

An important parameter in the operation of a mud motor is the differential pressure across the power section. It is this differential pressure that determines the torque developed by the motor. More specifically, the operating torque developed by the motor is proportional to the differential pressure. Typically a mud motor will be rated to produce a specified torque, which corresponds to a particular differential pressure. Most mud motors may exceed this rated torque for at least limited periods of time, although this requires application of proportionally higher differential pressures. For example, it is not uncommon for a mud motor to have a stall torque (i.e., the highest torque it can produce) that is approximately 2 to 2.5 times the rated torque. However, the basic construction of mud motors serves to limit the differential pressure that may be applied without damaging the motor.

For example, the stator of the power section is typically lined with an elastomer that allows for sealing between the rotor and stator, which is required for operation of the motor. Excessive differential pressure can cause drilling mud to bypass this seal, thereby subjecting the elastomer material of the stator to failure in such forms as chunking or excessive erosion. In some cases this damage may be immediate and catastrophic, resulting in complete failure of the motor. In other cases, limited damage to the elastomer may result, in which case the motor is still operable but can no longer develop the same stall torque. Additionally, in these cases of limited damage, further operation at higher torque levels that may have previously been non-damaging will become further damaging due to the condition of the stator. To protect the power section from either type of damage, it would be desirable to limit the differential pressure applied across the power section of the motor.

The mud motor transmission section can also be damaged by excessive differential pressure. Like any rotational mechanical system, the transmission system has strength limits that are a function of design, size of components, materials, etc. Because of shock loading, also known as dynamic factor or dynamic load, in many cases the transmission section can experience 2 to 2.5 times the torque load that the power section experiences, i.e., 2 to 2.5 times the torque developed by the power section. Depending on various design constraints such as costs, packaging, etc. it may not be possible or practical to design a transmission section for a particular application that could withstand full dynamic loading at the stall torque of the motor. Thus, in such cases, it would be desirable to limit the differential pressure applied to protect the transmission section from mechanical failure.

Additionally, there are many other conceivable applications in which it is desirable to limit differential pressure in a downhole environment. Such applications need not be limited to the use of mud motors, or even to drilling operations, but could arise in completion, treatment, stimulation, or other wellbore operations. In all of the foregoing and other operations, what is needed in the art is an effective, reliable, and repeatable mechanism for protecting downhole tools or the formation itself from the deleterious effects of high differential pressures.

SUMMARY OF THE INVENTION

According to a first aspect a downhole differential pressure safety valve is provided. The downhole differential pressure safety valve can include a housing assembly configured to be made up in a drill string above a downhole device and defining a throughbore. One or more relief ports can be provided through a wall of the housing assembly, thereby providing a fluid communication path between the throughbore and an exterior of the housing assembly. An inner mandrel assembly can be disposed within the housing assembly and moveable between at least a first position in which the fluid communication path is obstructed by the inner mandrel assembly and a second position in which the fluid communication path is not obstructed by the inner mandrel assembly. A biasing mechanism may be disposed within the housing assembly in a position to urge the inner mandrel assembly toward the first position. A differential pressure sensing arrangement urging the inner mandrel assembly toward the second position can also be provided, such that the biasing mechanism and differential pressure sensing arrangement are configured to cause the inner mandrel to move from the first position to the second position in response to a differential pressure sensed by the differential pressure sensing arrangement.

The downhole differential pressure safety valve can further include a trigger mechanism configured to retain the inner mandrel assembly in the first position until the differential pressure sensed by the differential pressure sensing arrangement exceeds a first threshold differential pressure. At this first threshold differential pressure, the trigger can be configured to and allow the differential pressure sensing arrangement to move the inner mandrel assembly from the first position to the second position. Additionally, the trigger can operate bi-directionally, such that the trigger mechanism is further configured to retain the inner mandrel in the second position until the differential pressure sensed by the differential pressure sensing arrangement falls below a second threshold differential pressure lower than the first threshold differential pressure. When this second threshold differential pressure is reached, the trigger mechanism can trip and allow the biasing mechanism to move the inner mandrel from the second position to the first position. The trigger mechanism can be a collet cooperating with one or more grooves on an interior surface of the housing assembly. Substitution of the collets having different dimensions or material properties can be used to configure the threshold differential pressures.

The differential pressure sensing arrangement can be an unbalanced piston, which can be part of the inner mandrel assembly. The biasing mechanism can be a coil spring. Either substitution of or preload on the biasing mechanism can be used to configure the first and second differential pressures. Preload can be adjusted by use of preload sleeves disposed within the housing, or different lower subs of the housing having different heights of the biasing mechanism bearing surface may be substituted.

According to a further aspect, a method of limiting the differential pressure applied across a downhole tool in a wellbore is provided. The method can include disposing within a tool string a differential safety valve configured to open at a first differential pressure and close at a second differential pressure lower than the first. Opening the differential safety valve can cause fluid to pass from a throughbore of the tool string into the wellbore, bypassing the downhole tool, thereby decreasing the differential pressure across the downhole tool. Conversely, closing the differential pressure safety valve prevents fluid from passing from the throughbore of the tool string into the wellbore without passing through the downhole tool. The first and second differential pressures, as well as the bypass flow rate, can be configurable. The opening and closing differential pressures can be configured by selection of various combinations of springs, preload devices, and collets. Bypass rate can be configured by positioning a nozzle within a relief port of the differential safety valve.

According to a third aspect, a downhole tool is provided. The downhole tool includes a housing defining one or more relief ports providing a fluid communication path from an interior of the tool to an exterior of the tool. Disposed within the housing is an unbalanced piston movable between at least a first position obscuring and a second position not obscuring the relief ports. The piston can include at least a first shoulder acted upon in a first direction by fluid pressure within the housing and a second shoulder acted upon in a second direction opposite the first direction by fluid pressure within the housing. The tool can further include an inner mandrel disposed within the housing and coupled to the piston and a biasing member disposed between the inner mandrel and an interior surface of the housing and acting against the inner mandrel in the second direction. Finally, the tool can include a trigger mechanism comprising a collet having a generally cylindrical portion coupled to the inner mandrel and a plurality of fingers extending from the generally cylindrical portion and having. Each finger can have at its end distal the cylindrical portion a head configured to engage first or second grooves on an interior of the housing corresponding to the first and second positions. The trigger mechanism can be responsive to the forces exerted by the piston and the biasing member on the inner mandrel so as to prevent the piston from moving from the first position to the second position until a differential between the pressure within the housing and the fluid pressure exterior to the housing is greater than a first predetermined value and to prevent the piston from moving from the second position to the first position until the differential between the pressure within the housing and the fluid pressure exterior to the housing is less than a second predetermined value less than the first value.

The piston can be exposed to fluid pressure exterior to the tool by way of one or more hydrostatic compensation ports through the housing, and this exposure can generate a force in the second direction. The tool can also include nozzles that are disposed within the one or more relief ports to configure the tool.

Dimensional or material properties of the collet may be varied to determine the opening and closing pressures. Such dimensional properties can include the length of the collet fingers and/or the profile of the collet head. Further configuration of the pressures may be controlled by selecting of the biasing member, e.g., a coil spring, and its attendant parameters, such as spring constant and preload. Preload may be achieved with either a collar or by configuration of the housing, e.g., with different lower subs having varying spring perch heights.

The tool can also include a seal cooperating with the piston and inner wall of the housing to prevent fluid flow from the interior to the exterior of the tool when the piston is in the first position. The seal can be disposed in a groove in either the piston or the housing such that the seal does not prevent flow from the interior of the tool, through the bypass ports, to the exterior of the tool, when the piston moves to the open position. The seal can be a conventional elastomeric seal, or a multi-element seal comprising an elastomeric sealing element and a non-elastomeric sealing element. The seal could also be a bonded seal.

BRIEF DESCRIPTION OF THE DRAWINGS

Aspects of the present invention will become apparent from the following description when taken in combination with the accompanying drawings in which.

DETAILED DESCRIPTION OF THE DRAWINGS

Disclosed herein is a downhole differential pressure safety valve, also known as a differential safety valve "DSV". The disclosed DSV is described in terms of a torque limiting device for a downhole mud motor; however, the disclosed DSV may be used in and/or adapted for a variety of other applications in which it is desirable to limit downhole differential pressure.

Figure 1A:
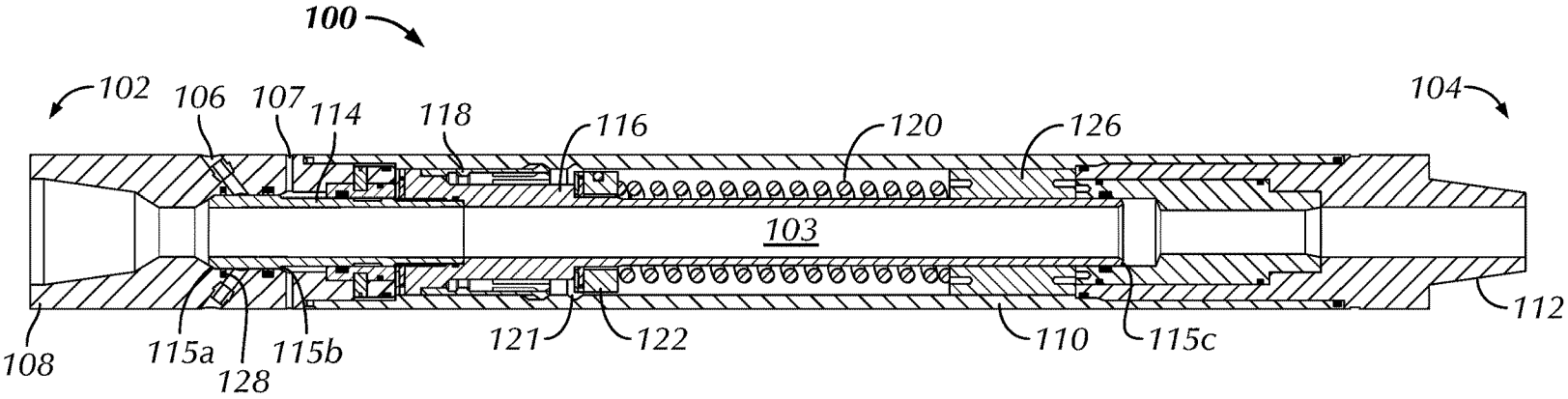
FIG. 1A illustrates a differential pressure safety valve in the closed position.
Figure 1B:
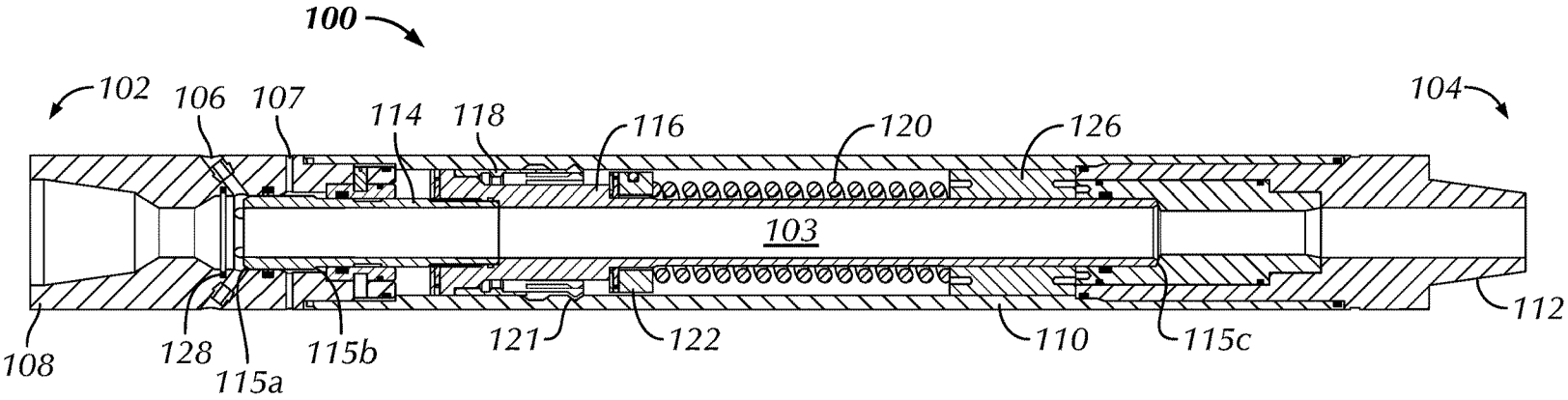
FIG. 1B illustrates a differential pressure safety valve in the open position.

Illustrated in FIGS. 1A and 1B is an embodiment of a DSV 100. FIG. 1A illustrates the DSV in the closed position. In the closed position mud flow passes from the uphole end 102, through the center bore 103, to the downhole end 104, and onward to a mud motor (or other tool) further down the string. FIG. 1B illustrates the valve in the open position. In the open position at least a portion of the mud flow is diverted through relief ports 106 to the wellbore annulus (not shown) to limit the differential pressure applied to a downstream device (not shown), such as a mud motor. The DSV is configurable during assembly at the surface to open and close at predetermined differential pressures.

In applications in which the purpose of the DSV is protection of a mud motor, it would generally be desirable to have the valve open at a differential pressure that is somewhere between the differential pressure corresponding to the rated torque of the mud motor and the differential pressure corresponding to the stall torque of the mud motor. These pressures are typically available from the mud motor manufacturer. In some embodiments an opening pressure of approximately 200 psi over the motor rated pressure may be appropriate. In other applications, the geologic conditions of the formation may be such that maintaining the quality and structural integrity of the wellbore requires limiting the rate of penetration of the drill bit. In such applications, the opening differential pressure of the DSV may be selected so as to limit the torque of the mud motor to some level lower than its rated torque, thereby limiting rate of penetration (ROP) of the drill bit to the desired value.

Closing pressure is also configurable. In some applications, a closing pressure approximately 700 psi less than the opening pressure may be used. The drilling operator can determine that the valve has opened by a rapid pressure drop in differential pressure, which can be measured at the surface and by the lack of ROP. The drop in differential pressure is due to the drilling fluid being diverted through the relief ports 106. The lack of ROP is due to the mud motor no longer being driven, due to the diverted flow. In response to these conditions, the drilling operator would typically reduce the pressure/flow of drilling fluid by throttling the mud pumps or taking them off line, allowing the pressure within the drill string to fall, thus reducing the differential pressure across the valve. The rate at which the differential pressure drops is primarily a function of the configuration of the relief ports 106. In some embodiments it may be desirable to configure the relief ports for particular flows or pressures by installation of nozzles within the ports, as will be discussed further below. It would typically be preferable to have the pressure bleed off as rapidly as possible, to prevent damage to the downhole components protected by the DSV.

Operation of the DSV may be better understood with reference to the components of the DSV embodiment 100 illustrated in FIGS. 1A and 1B. It should be understood that not all components illustrated or discussed need be present in any embodiment, but these are merely illustrative of an embodiment. Starting at the "uphole" end 102, the outer housing of DSV 100 includes a ported top sub 108. Top sub 108 is connected to housing 110, which, in turn, is connected to bottom sub 112 located at the "downhole" end 104. The connections between top sub 108, housing 110, and bottom sub 112 may take any of a variety of forms known for downhole tools, typically threaded connections. Collectively, these members may be considered a housing assembly. In some embodiments, this housing assembly could be partially or fully integrated into a single member, more or fewer members, joined in other ways (e.g., welding), etc. In the illustrated embodiment, various seals (illustrated, but not numbered in FIGS. 1A and 1B) may be provided at the joints between top sub 108, housing 110, and bottom sub 112 to provide fluid-tight integrity of the outer housing. The uphole end of top sub 108 and the downhole end of bottom sub 112 include threaded connections for making up the drill string.

The operating mechanism of DSV 100 is disposed within the outer housing, and includes piston 114, inner mandrel 116, trigger mechanism 118, and spring 120. Piston 114 is directly coupled to inner mandrel 116. In some embodiments, piston 114 and inner mandrel 116 could be a single, integrated component. As illustrated in FIG. 1A, piston 114 is subjected to a net force that is a function of a differential pressure that is the difference between the mud pressure within the centerbore 103 and the hydrostatic pressure in the wellbore annulus, which, assuming little pressure drop across the DSV itself, is substantially the same as the differential pressure applied across the mud motor or other tool protected by the DSV.

More specifically, mud pressure within centerbore 103 acts on upper shoulder 115*a* of piston 114. Mud pressure also acts on lower shoulder 115*c* of inner mandrel 116. However, the area of upper shoulder 115*a* is greater than that of lower shoulder 115*c*, such that the net force generated by the mud pressure within centerbore 103 is always acting downward on piston 115/inner mandrel 116. This arrangement is known as an "unbalanced piston." Hydrostatic annulus pressure acts on lower shoulder 115*b* of piston 114 by way of hydrostatic compensation ports 107. The area of lower shoulder 115*b* can be selected to achieve the desired force balance for the desired arrangement. In some, and possibly most, embodiments, the area of lower shoulder 115*b* can be less than either upper shoulder 115*a* or lower shoulder 115*c*. In any case, pressure in centerbore 103 will generate a net downhole force on piston 114 (to the right in FIGS. 1A and 1B). This downhole motion is resisted by the pressure in centerbore 103 acting upward on lower shoulder 115*c*, as well as by spring 120, which bears on lower shoulder 121 of inner mandrel 116 through spring bushing 122. It should be noted that spring bushing 122 is not required, and spring 120 could bear directly on lower shoulder 121.

As explained by Hooke's law, the distance a linear spring is compressed or extended is directly proportional to the force applied to the spring. In the DSV 100 illustrated in FIG. 1A, the force acting on the spring is determined by the differential pressure acting on piston 114 and the areas of upper shoulder 115*a* and lower shoulder 115*b*. DSV 100 is designed as an unbalanced piston, meaning that the area of upper shoulder 115*a* is greater than the area of lower shoulder 115*b*. This means that there is generally a force acting on piston 114 (and thus on inner mandrel 116) that tends to open the valve. This force is resisted by spring 120, which exerts a force on shoulder 121 of inner mandrel 116 tending to close the valve. Assuming a constant pressure in the annulus (and acting on lower shoulder 115*b*), an increase in pressure in centerbore 103 will increase the downhole force exerted on piston, tending to compress the spring. As the differential pressure increases, spring 120 becomes sufficiently compressed that downward movement of piston 114 exposes relief ports 106 opening the valve. This open position is illustrated in FIG. 1B.

Each incremental change in the force applied to a spring will result in a corresponding incremental change in the deflection of the spring. Depending on the specific pressures and flow rates involved, this could result in a situation in which the piston ends up oscillating between an open (or partially open) position and a closed (or partially closed position). In many situations, this oscillation and/or partial opening and closing of the relief ports may not be desirable. Additionally, it would be a challenge to design a valve that would allow independently selectable opening and closing pressures with such an arrangement, as the delta between the opening and closing pressures would be highly dependent on pressure and flow rate. To overcome these issues and allow for more independence between the opening and closing pressures (i.e., more control over the opening pressure, closing pressure, and the delta between the two), DSV 100 includes trigger mechanism 118.

Figure 2:
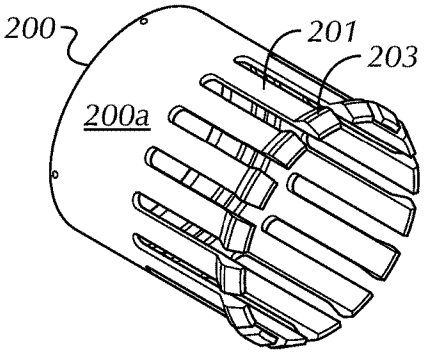
FIG. 2 illustrates a differential pressure safety valve trigger mechanism having a collet and cooperating slots.
Figure 2:
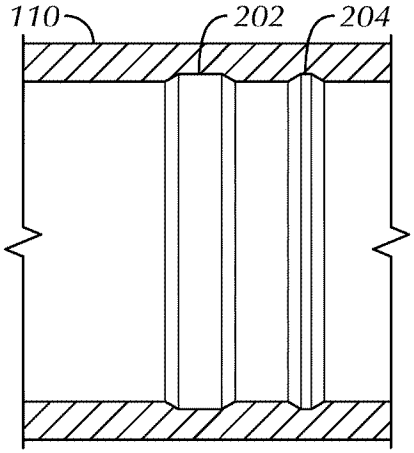

Turning now to FIG. 2, trigger mechanism 118 includes a collet 200 that cooperates with recessed circumferential groves or slots 202 and 204 machined on the interior of housing 110. Collet 200 is secured to inner mandrel 116 and thus is also indirectly connected to piston 114. Collet 200 may be secured to inner mandrel in a variety of ways, including interference fit, screws, bolts, welding, etc. Alternatively, collet 200 could be unitary with inner mandrel 116 and/or with piston 114. Collet 200 is formed from a generally cylindrical body portion 200*a* that extends into a plurality of fingers 201. This generally cylindrical body portion may be circular in cross section, or, in a given design, may have other shapes, such as polygonal, ellipsoidal, etc. Each of the plurality of fingers 201 has a head 203 that engages with grooves 202 and 204 to serve as both an opening trigger and a closing trigger for the DSV as further described below.

Figure 3A:
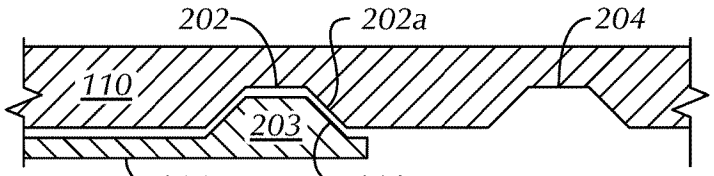
FIG. 3A diagrammatically illustrates interaction of the collet head and slots of the trigger mechanism when the valve is in the closed position.
Figure 3B:
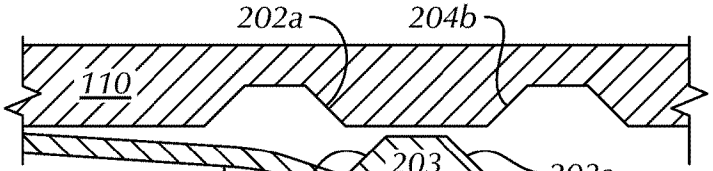
FIG. 3B diagrammatically illustrates interaction of the collet head and slots of the trigger mechanism when the valve is in a transient intermediate position between the closed and open positions.
Figure 3C:
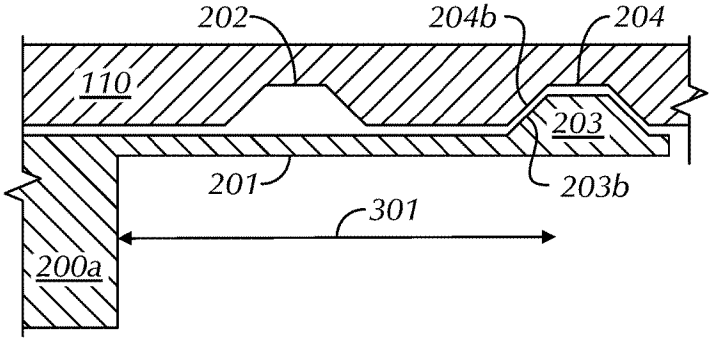
FIG. 3C diagrammatically illustrates interaction of the collet head and slots of the trigger mechanism when the valve is in the open position.

FIGS. 1A and 1B illustrate the trigger mechanism in the valve closed and valve open positions, respectively. FIGS. 3A-3C diagrammatically illustrate a cross section of one collet finger 201, having a head 203 engaging the two circumferential grooves 202 and 204. FIG. 3A corresponds to the closed position. In this position, collet head 203 is disposed within groove 202 in housing 110. The differential pressure applied to piston 114 (shown in FIG. 1A) will apply a force in a downhole direction (rightward in FIGS. 1A and 3A), which is resisted by the force of spring 120. The resultant force will cause leading edge 203*a* of collet head 203 to engage bearing surface 202*a*. This engagement will create an additional force, i.e., a triggering force, resisting the tendency of the valve to open.

The magnitude of this triggering force can be controlled and selected by the DSV designer by manipulating various collet and groove parameters. In general, these parameters relate to geometric and materials properties of the system. Such parameters include the length, cross-sectional area, and the stiffness of the material of the collet fingers 201 as well the size, shape, and any coatings applied to collet head 203. In addition to such intrinsic properties, the collet can be pre-stressed or pre-deformed to further affect operation of the system. It should be noted that the angle of bearing surface 202*a* forming the wall of groove 202 will generally be selected to correspond to that of leading edge 203*a* of collet head 203 and will have a substantial impact on the additional force resisting opening of the valve. This additional triggering force should be greater than the force required to compress the spring sufficiently to allow the valve to fully open. In one embodiment, the triggering force is greater by roughly 10%. Once this triggering force is exceeded, the force generated by the differential pressure acting on piston 114 will be greater than that required to compress spring 120 sufficiently to allow longitudinal movement of piston 114 and inner mandrel 116 such that collet head 203 latches into groove 204. Thus, when the triggering force is exceeded, piston 114 and inner mandrel 116 will quickly move from the closed position (in which collet head 203 of the triggering mechanism is retained in groove 202 and in which relief ports 106 are blocked by piston 114) to the open position (in which collet head 203 of the triggering mechanism is retained in the groove 204*b* and in which relief ports 106 to the inner bore 103 of the DSV).

FIG. 3B illustrates the transient state between the opening and closing of the valve. In this state, collet fingers 201 are deflected inward by the interior surface of housing 110. Because the triggering force of the valve has been overcome and leading edge 203*a* of collet finger 203 is no longer bearing against bearing surface 202*a* of groove 202, the only force resisting downhole motion of piston 114, inner mandrel 116, and collet 200 is the biasing force of spring 120 acting on inner mandrel 116. However, as noted above, the differential pressure acting on piston 114 is sufficiently greater than the resisting force supplied by spring 120 that the entire piston and inner mandrel assembly quickly moves to the open position, illustrated in FIG. 3C.

FIG. 3C illustrates the open position of the valve. In this state, relief ports 106 (FIGS. 1A and 1B) are open, allowing fluid to pass from centerbore 103 of the tool into the wellbore annulus. This reduces the differential pressure acting on piston 114. In most cases, this differential pressure reduction would be sufficient such that the downhole force exerted by piston 114 would be less than that supplied by spring 120. In this case the net force acting on the piston and inner mandrel assembly tends to re-close the valve. However, it may be desirable to also provide a closing triggering mechanism so that the differential pressure at which the valve closes can be more precisely controlled and sufficiently separated from the opening pressure. The closing trigger can operate substantially similarly to the opening trigger, i.e., a trailing edge 203*b* of collet head 203 can bear against a bearing surface 204*b* of groove 204 in housing 110. As with the opening trigger discussed above, the geometric and materials properties of the collet finger 201, collet head 203, and groove 204 can determine the closing triggering force that tends to resist the force supplied by spring 120 to close the DSV. Additionally, it is not necessary that the geometric and materials properties of the collet head be the same on the leading/trailing edges corresponding to the opening/closing operation. Depending on the particular embodiment, it may be desirable to have different angles, different coatings, etc. on the opposite sides of the collet head to achieve the desired operation. As with the opening triggering force, the closing triggering force in some embodiments can be selected to be about 10% less than the force that would allow the spring to return the valve to the closed position. Once the sum of the force generated by the differential pressure acting on piston 114 and the closing triggering force is exceeded by the biasing force exerted by spring 120, collet head 203 will pop out of groove 204, allowing the piston and inner mandrel assembly to move uphole (leftward in the figures), causing relief ports 106 to be closed by piston 114 and allowing collet head 203 to re-seat in groove 202. Thus, when the differential pressure is reduced to a predetermined acceptable level, the DSV automatically returns to the closed and is ready for subsequent operation.

Other trigger mechanism configurations are also possible. For example, separate collets could be used for the opening and closing triggers. Alternatively, other trigger mechanisms could also be used, either separately or together with collets. Examples of such devices could include ball and detent arrangements, electronic triggers, etc. In other arrangements, the grooves cooperating with the collet head could be located on the piston/mandrel rather than on the interior of the housing. In any case, for a DSV constructed as described above, there are three principal configuration parameters that an operator may desire to configure. These parameters are: (1) opening pressure, (2) closing pressure, and (3) bypass flow (i.e., how quickly the tool can correct a high differential pressure condition). In the tool design phase, opening pressure is determined primarily by the rate of spring 120 and, more specifically, by the biasing force supplied by spring 120. As noted above, opening pressure is also affected in the design phase by the additional triggering force required to dislodge collet heads 203 from groove 202, as well as the expected range of differential pressures and the sizes of upper shoulder 115*a* and lower shoulder 115*b* of piston 114. Similarly, closing pressure is determined in the design phase primarily by the rate of spring 120 and is further affected by the closing triggering force required to dislodge collet heads 203 from groove 204, as well as the expected range of differential pressures and the sizes of upper and lower shoulders 115*a* and 115*b* of piston 114. Bypass flow is determined in the design phase by the range of differential pressures expected and the number, size, and configuration of relief ports 106.

Once the design ranges of the DSV are established, the tool can still be adjusted or configured by the operator for particular operations. The most readily adjustable parameters are spring force, which will affect opening and closing pressure, and relief port jetting, which will affect the relief port flow rate. In embodiments using coil springs, the spring force can be adjusted either by substituting a spring of a different rate or, more simply, by changing the preload on the spring. Turning back to FIGS. 1A and 1B, spring preload is provided by preload collar 126. Preload collar 126 provides initial compression to spring 120, which provides additional resistance to further resistance of the spring. Thus, while the spring rate remains constant, this additional resistance, plus the resistance due to the spring constant times the distance the end of the spring is displaced between the closed and open positions, must be overcome to operate the valve. To simplify, the longer spring preload collar, the greater the initial compression of the spring tending to resist further compression, and the greater differential pressure applied to piston 114 will be required to open the valve. In some embodiments, it may be desirable to specify a minimum length of the preload collar 126 to ensure that spring 120 has sufficient energy stored therein to ensure the piston/inner mandrel assembly stabs completely back into seal 128. (Seal 128 is discussed in greater detail below.)

Rather than incorporating a separate spring preload collar 126 (as illustrated), spring force configuration may instead be configured by supplying different bottom subs 112 with different heights of the spring seating surface relative to the lower end of the sub. This can provide various operational advantages. For example, the different bottom subs could be marked with identification that would allow an operator to determine the opening and closing forces by looking at the exterior of the tool, without having to consult paperwork or electronic records associated with the tool to determine its internal configuration.

Although spring 120 is illustrated as a coil spring, other biasing mechanisms could be used. Such biasing mechanisms could include, without limitation, gas springs (i.e., a pressure chamber and piston in which gas pressure acting on the piston serves to bias the piston in a particular direction), elastomeric materials, bladders, leaf springs, and other types of biasing mechanisms. In the case of other spring types, opening and closing pressure adjustments may require other techniques rather than preload collar 126. For example, in a gas spring, the pressure in the gas reservoir may be increased to set the opening and closing pressures at a higher differential pressure or vice versa. For elastomeric members, an elastomer made of a different material or having different dimensions may be appropriate. Other adjustments could also be made depending on the exact nature of the biasing member.

As noted above, the material and configuration of collet 200 can further affect the opening and closing pressure. As noted above with respect to FIGS. 3A-3C, the profiles of collet head 203 and grooves 202 and 204 are key parameters that generally must be set at the design stage. This is because replacement of housing 110 may not be practical, yet the profiles of collet heads 203 must correspond to the profiles of grooves 202 and 204 to the degree necessary to achieve the desired trigger force. However, the opening and closing triggering forces may still be adjusted by providing substitute collets made of different materials and/or having collet fingers 201 with different effective beam lengths and/or cross-sections. (As illustrated in FIG. 3C, the effective beam length 301 of collet finger 201 is the distance between the end of the collet finger proximate the cylindrical body portion 200*a* of the collet and the centerline of the collet head profile.) In other embodiments, such as where a high trigger force is desired, the engaging profile of the collet could be located between the supports of simply supported beam (as opposed to the cantilevered arrangement described above). Other configurations of the collet are also possible.

As yet another alternative, collet 200 and the cooperating grooves could be eliminated from the tool design. In such a case, the freedom of motion of the tool discussed above may be advantageously harnessed to create a pressure regulating valve. In such an embodiment, displacement of the piston and inner mandrel assembly could be configured to expose various flow ports. These ports could be designed so as to cooperate with the biasing force of the spring to regulate pressure and or flow through the tool into a desired range.

Bypass flow is also a configurable parameter, and determines how quickly the DSV can respond to limit the differential pressure applied to a downstream tool and also how much differential pressure the DSV can divert. As noted above, this is determined at the design phase by the number, size, and length of relief ports 106. It bears mentioning that, as illustrated in FIGS. 1A and 1B, relief ports 106 may be oriented so that they are not directly radial to the tool, but rather divert flow either upwards or downwards. This can prevent the diverted mud flow from causing washouts or other damage to the borehole walls. Additionally, for specific configuration needs, relief ports can be configured to accept nozzle inserts and/or plugs that allow further configuration of the area or number of the ports to achieve desired operating parameters. In many embodiments, it may be desirable to select the nozzle size and flow parameters such that, for the expected range of flows and differential pressures, at least some flow through the DSV to the mud motor (or other protected equipment) is maintained. This may be desirable for a variety of purposes, such as cooling of the drill bit or MWD/LWD equipment, maintaining sufficient power to a mud pump drive electrical generator powering MWD/LWD equipment, or to maintain sufficient mud flow to circulate out cuttings to prevent them from setting up and sticking the drill bit.

Turning back to FIGS. 1A and 1B, one can see a variety of seals (unlabeled) that prevent fluid migration through various portions of the tool. In general these seals may be selected and configured to achieve a particular result intended by the tool designer. In some instances, further considerations of the seal design, material, etc. is warranted. One such seal is seal 128, which is the operating seal in top sub 108 that isolates centerbore 103 of the DSV 100 from relief ports 106. To achieve maximum repeatable reliability, the tool can be designed such that piston 114 and/or inner mandrel 116, which seals relief/vent ports 106 when DSV 100 is in the closed position, fully disengages (stabs out) seal 128 to vent pressure when DSV 100 opens and then reengages (stabs into) seal 128 when the valve resets (i.e., returns to the closed position). This stab-in/stab-out operation protects the integrity of seal 128 by preventing seal erosion caused by high velocity flow past the seal that would occur if the piston and/or inner mandrel were to be only partially displaced past the seal.

Additionally, the seal can be constructed in a variety of manners. It is possible to use a conventional elastomer seal, such as an O-ring in this location. However, such a seal might not provide sufficient sealing capability or durability in some applications. For example, the differential pressures to which seal 128 might be subjected may render a conventional elastomer seal inadequate. Moreover, repeated operation and/or the high flow velocities past the seal might result in erosion of such a seal. Alternatively, a non-elastomer seal made of a thermoplastic (such as PEEK®) or a fluoropolymer (such as Teflon®) or a similar material could be used in this location. However, these types of seals also have disadvantages, such as expense and the inability to design a true "zero-leakage" seal.

Figure 4:
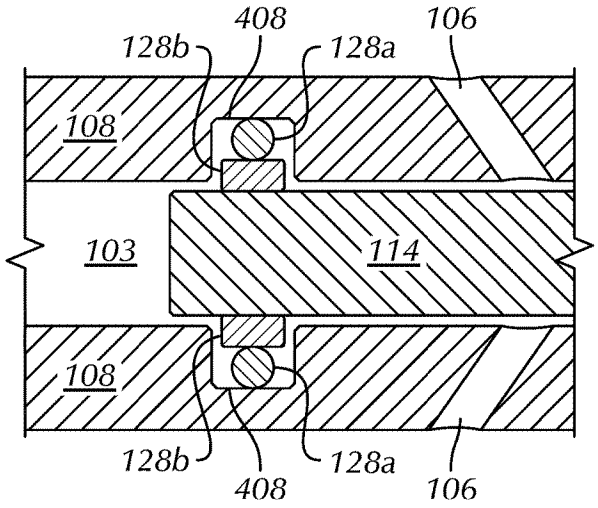
FIG. 4 diagrammatically illustrates an embodiment of a seal between the throughbore of the upper sub and the relief ports.

In some embodiments, these disadvantages can be overcome using a multi-element seal as illustrated in FIG. 4. FIG. 4 diagrammatically illustrates a two-piece seal with DSV 100 in the closed position. While a two-piece seal is shown, a multi-element seal having another number of elements could be used. It should be noted that FIG. 4 is not to scale an clearances between the various components have been exaggerated for clarity of illustration. As shown, two-piece seal includes an elastomeric element 128*a*, and a non-elastomeric element 128*b*. Non-elastomeric element 128*b* may be either a non-metallic element made of thermoplastic or fluoropolymer or similar material, or can be a metallic element.

In any case, both seal elements are disposed so as to form a seal between the interior of top sub 108 and piston 114. In the illustrated embodiment, the seal elements are disposed in groove or slot 408 formed in the interior of top sub 108. However, a groove or slot could also be formed in piston 114 to accept the seal. Non-elastomeric seal element 128*b* bears against piston 114 to isolate centerbore 103 from relief ports 106 when the valve is closed. This sealing is more effective due to the energizing effect of elastomeric sealing element 128*a*, which bears against non-elastomeric element 128*b* and the wall of slot 408 to bias non-elastomeric seal element 128*b* against piston 114. Additionally, elastomeric sealing element 128*a* also itself serves as an additional sealing element for fluid that would otherwise attempt to bypass non-elastomeric seal element 128*b* by passing behind it through groove 408. As an alternative to a multi-element seal, a bonded seal could also be used.

Figure 5:
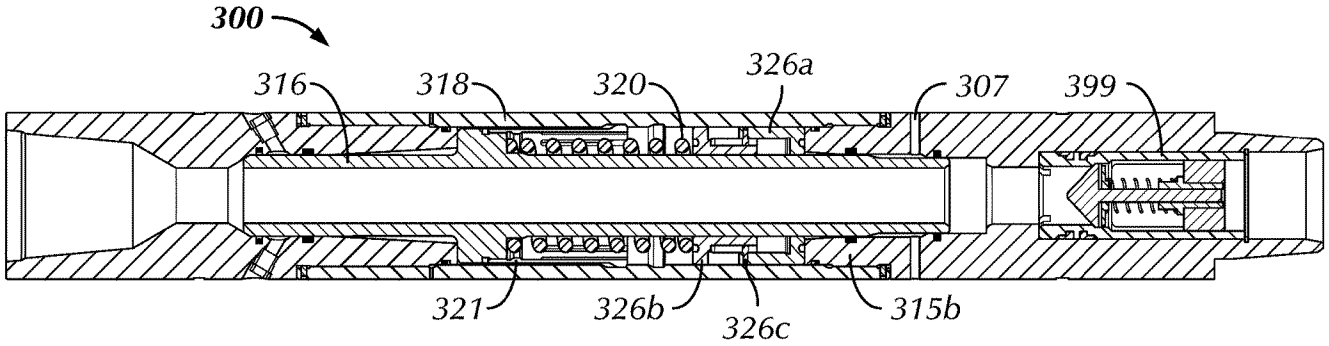
FIG. 5 illustrates an alternative embodiment of a differential pressure safety valve.
Figure 6A:
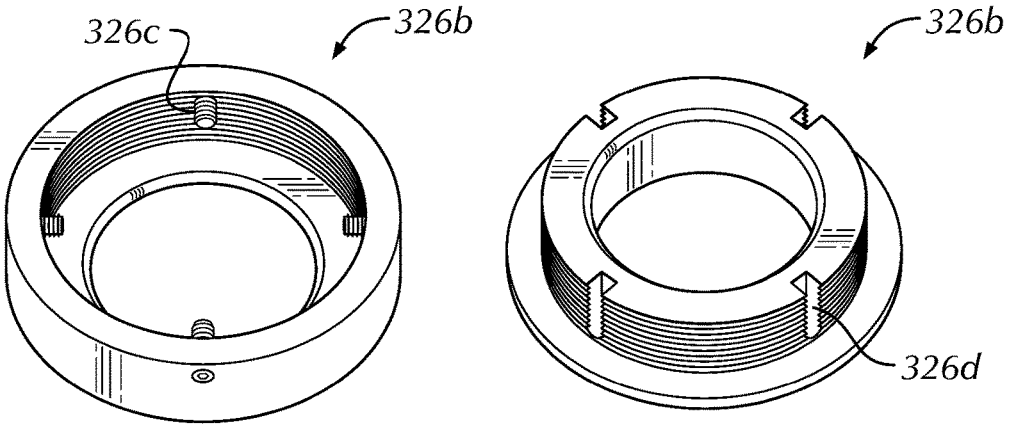
FIG. 6A illustrates an adjustable preload sleeve in a disassembled condition.
Figure 6B:
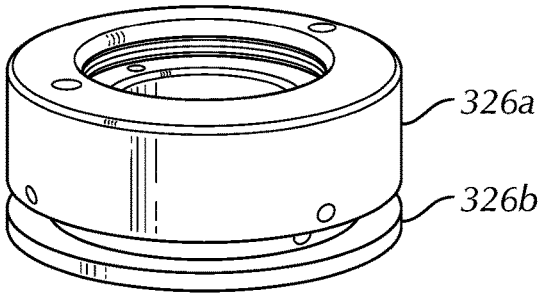
FIG. 6B illustrates an adjustable preload sleeve in an assembled condition.

An alternative embodiment of DSV 300 is illustrated in FIG. 5. The following description highlights various differences between the FIG. 5 embodiment 300 and the embodiment 100 illustrated in FIGS. 1 and 2, which otherwise is designed and operates similarly. One change with respect to DSV 300 is that spring 320 and its associated bearing structures have been reconfigured. As can be seen in FIG. 5, there is no spring bushing corresponding to spring bushing 122 illustrated in FIGS. 1 and 2. Rather, spring 320 bears directly on shoulder 321 of the inner mandrel 316. Additionally, in DSV 100, spring preload sleeve 126 is a single element, which may be substituted as described above to configure operation of the valve. As noted above, this would require multiple different preload collars for different operating parameters. Conversely, in DSV 300, the spring preload collar is a multi-piece design comprising an upper portion 326*b* and a lower portion 326*a*. Interior threads on lower portion 326*a* may be engaged with exterior threads on upper portion 326*b* allowing the height of the combined assembly to be adjusted (the height of the assembly affecting spring preload as described above). Once the upper and lower portions are threaded together to achieve the desired length, set screws 326*c* (or other suitable locking mechanisms) may be employed to secure the preload collar in the specified position. These set screws 326*c* may, for example, pass through corresponding holes in lower portion 326*a* to engage recesses 326*d* in upper portion 326*b*. Other suitable configurations of set screws or other locking mechanisms are also possible.

Another difference with respect to the DSV illustrated in FIG. 5 is that the spring 320 is overlapping or concentric with locking collet 318. This provides several advantages, not the least of which is reduced overall length of the tool. It is well known that for many oilfield tools shorter lengths are always desirable. However, making this configuration change requires care to be taken with respect to sizing and squaring of spring 320 so as to eliminate the possibility of interference with the operation of locking collet 318.

Still another difference with DSV 300 illustrated in FIG. 5 is that hydrostatic compensation ports 307 and the associated piston surface 315*b* on which they act have been relocated to the bottom of the tool. Correspondingly, it is now the threads at the upper end of the tool that are the energizing threads for the spring mechanism. This design change, in at least some embodiments, allows for easier assembly, disassembly, and servicing of the tool. Other configurations are also possible without departing from the spirit and scope of the instant invention.

Finally, DSV 300 illustrated in FIG. 5 also includes an integral float valve 399. As is known to those in the art, it is often desirable to provide what are essentially check valves in various borehole assembly tools to prevent the reverse flow of drilling mud through the motor and/or the tool interior in the event that downhole pressure conditions would otherwise allow for such flow. In many prior art arrangements, such valves were integrated in separate subs, which added to the overall length of the tool string, and was thus considered to be undesirable. By adapting the bottom sub as illustrated in FIG. 5, such valves can be incorporated directly in the DSV, eliminating the need for a separate sub. This advantageously shortens and simplifies the drill string. It would be possible, whether alternately or additionally, to include such a valve in the upper portion of DSV 300 if desired.

Variations, additions, modifications, or alternatives to the DSV design discussed above are also possible. As one example, rather than the collet-based trigger for resetting the valve from the open position to the closed position, a J-slot mechanism could be used. Additionally, one could design the valve to incorporate an operational feature that would allow the valve to be opened and remain open to allow drilling fluid to drain from the drill string during a wet trip operation.

As another example, the hydraulics of the tool could be adapted to provide desired features. One such feature would be some sort of internal flow diversion that would cause the tool in the relief mode to generate pressure and flow characteristics corresponding to those that would be generated by a stalled motor. This would assist an operator in understanding what is happening downhole and running the drilling program appropriately. Another such feature could be a compensation system that would allow the valve to compensate for the differential pressure contribution from the drill bit as separate from that of a mud motor, allowing for potentially higher differential pressure operation without risking damage to the motor. Such an embodiment could be established by allowing the pre-load sleeve to float longitudinally within the housing and a compensating system of seals and nozzles to match the pressure drop across the drill bit. Motor hydraulics and motor friction could also be incorporated into such a system using one or more control lines conveying hydraulic pressures from the motor to the DSV. In other embodiments, the tool could be configured to completely shut off and/or divert fluid flow from the tools or components below.

Additionally, with the advent of downhole electronics systems, including but not limited to MWD/LWD systems, it would also be possible to augment the DSVs control and monitoring with these electronics. For example, it may be desirable to allow for an MWD package to determine the operating state of the valve, control the valve, or even adjust the opening and/or closing pressure or selectively defeat the valve to temporarily allow higher differential pressure operation. In still other applications, complete electronic control of the valve could be designed, in which pressure sensors and solenoid valves are used to control the trigger points and or open/close status of the valve.

These and other modifications to the DSV to achieve various desired operational characteristics will be apparent to those skilled in the art having the benefit of this disclosure. It is intended that these and other modifications of the inventive concepts described herein fall within the scope of the appended claims.

The invention claimed is:

1. A downhole differential pressure safety valve, comprising:

a housing assembly configured to be made up in a drill string above a downhole device, the housing assembly defining a throughbore;

one or more relief ports through a wall of the housing assembly providing a fluid communication path between the throughbore and an exterior of the housing assembly;

an inner mandrel assembly disposed within the housing assembly and moveable between at least a first position in which the fluid communication path is obstructed by the inner mandrel assembly and a second position in which the fluid communication path is not obstructed by the inner mandrel assembly;

a biasing mechanism disposed within the housing assembly and urging the inner mandrel assembly toward the first position;

a differential pressure sensing arrangement exposed to internal fluid pressure in the throughbore and to external fluid pressure from the exterior and urging the inner mandrel assembly toward the second position in response to a differential pressure between the internal and external fluid pressures; and a trigger mechanism movable with the inner mandrel assembly and configured to engage first and second grooves of the housing assembly corresponding to the first and second positions;

wherein the trigger mechanism, the biasing mechanism, and the differential pressure sensing arrangement are configured to cause the inner mandrel assembly to move from the first position to the second position in response to a level of the differential pressure sensed by the differential pressure sensing arrangement.

2. The downhole differential pressure safety valve of claim 1 wherein the trigger mechanism is configured to retain the inner mandrel assembly in the first position until the differential pressure sensed by the differential pressure sensing arrangement exceeds a first threshold differential pressure and is further configured to trip and allow the differential pressure sensing arrangement to move the inner mandrel assembly from the first position to the second position when the first threshold differential pressure is reached.

3. The downhole differential pressure safety valve of claim 2 wherein the trigger mechanism is further configured to retain the inner mandrel in the second position until the differential pressure sensed by the differential pressure sensing arrangement falls below a second threshold differential pressure lower than the first threshold differential pressure and is further configured to trip and allow the biasing mechanism to move the inner mandrel from the second position to the first position.

4. The downhole differential pressure safety valve of claim 3 wherein the trigger mechanism comprises a collet cooperating with the first and second grooves disposed on an interior surface of the housing assembly.

5. The downhole differential pressure safety valve of claim 4 wherein the biasing mechanism comprises a coil spring at least partially overlapping the collet.

6. The downhole differential pressure safety valve of claim 5 wherein at least one of the dimensions or material properties configuring the first threshold differential pressure is different from a corresponding dimension or material property configuring the second threshold differential pressure.

7. The downhole differential pressure safety valve of claim 4 wherein substitution of the collets having different dimensions or material properties is used to configure the first and second threshold differential pressures.

8. The downhole differential pressure safety valve of claim 1 wherein the differential pressure sensing arrangement comprises an unbalanced piston exposed to fluid pressure within the throughbore and exterior to the housing assembly.

9. The downhole differential pressure safety valve of claim 8 wherein the unbalanced piston is part of the inner mandrel assembly.

10. The downhole differential pressure safety valve of claim 1 wherein the biasing mechanism comprises a coil spring.

11. The downhole differential pressure safety valve of claim 10 wherein the biasing mechanism further comprises a preload sleeve.

12. The downhole differential pressure safety valve of claim 11 wherein substitution of preload sleeves of different length is used to configure the first threshold differential pressure.

13. The downhole differential pressure safety valve of claim 11 wherein the preload sleeve is a multi-part sleeve that is adjustable to configure the first threshold differential pressure.

14. The downhole differential pressure safety valve of claim 10 wherein substitution of the coil spring is used to configure the first threshold differential pressure.

15. The downhole differential pressure safety valve of claim 10 wherein preload on the spring is adjusted by substituting a bottom sub of the differential pressure safety valve.

16. A method of limiting the differential pressure applied across a downhole tool, the downhole tool being located in a wellbore at the end of a tool string, the method comprising:

disposing within the tool string a differential safety valve configured to open at least one relief port in a housing at a first differential pressure and close the at least one relief port in the housing at a second differential pressure lower than the first, wherein opening the differential safety valve comprises: moving an inner mandrel in the housing from a first position to a second position in response to the first differential pressure between internal pressure inside the housing and external pressure outside the housing, triggering the inner mandrel to engage from a first groove to a second groove of the housing corresponding to the first and second positions, and causing fluid to pass from a throughbore of the tool string into the wellbore through the at least one relief port bypassing the downhole tool thereby decreasing the differential pressure across the downhole tool, and wherein closing the differential pressure safety valve comprises: moving the inner mandrel in the housing from the second position to the first position in response to the second differential pressure between the internal and external pressures, triggering the inner mandrel to engage from the second groove to the first groove of the housing corresponding to the second and first positions, and preventing fluid from passing from the throughbore of the tool string into the wellbore through the at least one relief port without passing through the downhole tool.

17. The method of claim 16 further comprising configuring at least one parameter selected from the group consisting of: opening differential pressure, closing differential pressure, and bypass rate.

18. The method of claim 16 wherein at least one of the opening and closing differential pressures are configured by selecting one or more of a spring, a preload device, and a collet.

19. The method of claim 16 wherein bypass rate is selected by positioning a nozzle within the at least one relief port of the differential safety valve.

20. A downhole tool comprising:

a housing defining one or more relief ports providing a fluid communication path from an interior of the tool to an exterior of the tool;

a piston disposed within a housing and movable between at least a first position in which the piston obscures the one or more relief ports and a second position in which the piston does not obscure the one or more relief ports, the piston further having a first shoulder acted upon in a first direction by fluid pressure within the housing and a second shoulder acted upon in a second direction opposite the first direction by fluid pressure within to the housing wherein the area of the first shoulder is greater than the area of the second shoulder;

an inner mandrel disposed within the housing and coupled to the piston;

a biasing member disposed between the inner mandrel and an interior surface of the housing and acting against the inner mandrel in the second direction; and a trigger mechanism comprising a collet having a generally cylindrical portion coupled to the inner mandrel and a plurality of fingers extending from the generally cylindrical portion and having, each finger having at its end distal the cylindrical portion a head configured to engage first or second grooves on an interior of the housing corresponding to the first and second positions;

wherein the trigger mechanism is responsive to the forces exerted by the piston and the biasing member on the inner mandrel so as to prevent the piston from moving from the first position to the second position until a differential between the pressure within the housing and the fluid pressure exterior to the housing is greater than a first predetermined value and to prevent the piston from moving from the second position to the first position until the differential between the pressure within the housing and the fluid pressure exterior to the housing is less than a second predetermined value less than the first value.

21. The downhole tool of claim 20 wherein the piston is exposed to fluid pressure exterior to the tool by way of one or more hydrostatic compensation ports through the housing and wherein such exposure generates a force in the second direction.

22. The downhole tool of claim 20 wherein nozzles are disposed within the one or more relief ports to configure the tool.

23. The downhole tool of claim 20 wherein at least one of the dimensional or material properties of the collet is varied to determine at least one of the first and second predetermined values.

24. The downhole tool of claim 23 wherein at least one of the dimensional properties varied is the length of the collet fingers.

25. The downhole tool of claim 23 wherein at least one of the dimensional properties varied is a profile of the collet head.

26. The downhole tool of claim 20 wherein the biasing member and collet are at least partially overlapping.

27. The downhole tool of claim 20 wherein operating parameters of the biasing member are varied to determine at least one of the first and second predetermined values.

28. The downhole tool of claim 27 wherein the biasing member comprises a coil spring and a preload collar and wherein at least one of the operating parameters comprises the length of the preload collar.

29. The downhole tool of claim 28 wherein the preload collar is a multi-piece, length adjustable assembly.

30. The downhole tool of claim 20 further comprising a seal cooperating with the piston and inner wall of the housing to prevent fluid flow from the interior to the exterior of the tool when the piston is in the first position.

31. The downhole tool of claim 30 wherein the seal is a multi-element seal comprising an elastomeric sealing element and a non-elastomeric sealing element.

32. The downhole tool of claim 30 wherein the seal is a bonded seal.

* * * * *